United States Patent [19]

Diemer et al.

[11] Patent Number: 4,622,688

[45] Date of Patent: Nov. 11, 1986

[54] X-RAY TUBE COMPRISING TWO SUCCESSIVE LAYERS OF ANODE MATERIAL

[75] Inventors: Willem H. Diemer, Eindhoven; John N. Kikkert, Almelo; Hubertus F. M. Wagemans, Eindhoven, all of Netherlands

[73] Assignee: U.S. Philips Corporation, New York, N.Y.

[21] Appl. No.: 613,655

[22] Filed: May 23, 1984

[30] Foreign Application Priority Data

May 25, 1983 [NL] Netherlands ..... 8301839

[51] Int. Cl.[4] ..... H01J 35/08

[52] U.S. Cl. ..... 378/143; 378/124

[58] Field of Search ..... 378/121, 143, 144, 124

[56] References Cited

U.S. PATENT DOCUMENTS

| | | | |
|---|---|---|---|
| 2,506,327 | 5/1950 | Harrington | 378/143 |
| 3,992,633 | 11/1976 | Braun et al. | 378/143 |
| 3,999,906 | 12/1976 | Funk et al. | 378/143 |
| 4,205,251 | 5/1980 | Zwep | 378/143 |

FOREIGN PATENT DOCUMENTS

| | | | |
|---|---|---|---|
| 0127230 | 12/1984 | European Pat. Off. | 378/121 |
| 2533348 | 6/1976 | Fed. Rep. of Germany | 378/143 |
| 2719609 | 11/1978 | Fed. Rep. of Germany | 378/143 |
| 1063386 | 3/1967 | United Kingdom . | |
| 1546363 | 5/1979 | United Kingdom | 378/143 |

*Primary Examiner*—Craig E. Church
*Assistant Examiner*—Charles F. Wieland
*Attorney, Agent, or Firm*—Robert J. Kraus

[57] ABSTRACT

An anode of an X-ray tube, particularly for X-ray analysis, comprises at least two successive layers (7, 8 or 11, 10 or 13, 12) of anode material. A first layer (7, 11, 12) thereof consists mainly of an element having a comparatively low atomic number, such as scandium or chromium, while a second layer (8, 10, 13) consists mainly of an element having a comparatively high atomic number, such as molybdenum, tungsten or uranium. For the selection of a desired radiation spectrum, the tube voltage is selectively adjusted such that either or both layers are activated.

13 Claims, 3 Drawing Figures

X-RAY TUBE COMPRISING TWO SUCCESSIVE LAYERS OF ANODE MATERIAL

BACKGROUND OF THE INVENTION

The invention relates to an X-ray tube comprising a cathode with an electron-emissive element and an anode with an anode target plate which are accomodated in an envelope having an exit window. An X-ray tube of this kind is known from U.S. Pat. No. 4,205,251.

For the study of elements having a comparatively low atomic number, for example lower than 30, by X-ray spectral analysis, known X-ray tubes are not ideally suitable because the X-rays generated therein contain an insufficient amount of long-wave X-rays. In order to generate comparatively soft and hence long-wave X-rays, use can be made of an anode material consisting of an element having a low atomic number. However, such an X-ray tube is not suitable for the study of elements having a high atomic number. Therefore, it is usually necessary to use several X-ray tubes for a complete analysis of an arbitrary specimen; this is annoying and time-consuming.

SUMMARY OF THE INVENTION

It is an object of the invention to provide an X-ray tube in which there can be selectively produced an X-ray beam containing a comparatively large amount of long-wave radiation as well as an X-ray beam containing a comparatively large amount of short-wave radiation, without affecting the outside construction, shape and useful properties of the X-ray tube. In accordance with the invention, an X-ray tube of the kind set forth in the opening paragraph of this specification is characterized in that the anode target comprises at least two layers of anode material which are situated one behind the other, viewed in the direction of an incident electron beam. A first layer thereof consists essentially of elements having an atomic number of at the most approximately 30, whilst a succeeding layer thereof consists mainly of elements having an atomic number of more than approximately 40, it being possible to apply such a potential difference between the anode and the cathode that X-rays are released from both layers of anode material.

Because the anode target plate comprises two successive layers of different anode materials, the radiation spectrum of the X-rays to be generated can be adapted to the relevant requirements by varying the potential difference applied between the cathode and the anode. In a preferred embodiment X-ray tube, the potential difference between the anode and the cathode of the X-ray tube can be switched between at least two values.

In a reflection X-ray tube embodying the invention, the first layer contains an element having a low atomic number. Using a comparatively small potential difference, X-rays are generated mainly therein. When a larger potential difference is used, mainly the second layer is activated and the X-rays generated therein can also emerge from the tube via the first layer and the exit window. When use is made of a potential difference which is adapted to the thickness and the absorption of the first layer, both layers can be activated for a radiation spectrum which is adapted to the need for analysis of the relevant elements.

In a preferred embodiment of a reflection X-ray tube, the anode material of the second layer, having an atomic number higher than 40, is selected from the elements Zr, Nb, Mo, Rh, Pd, Ag, Ta, W, Re, Au and U, and the anode material of the first layer, having an atomic number lower than 30, is selected from the elements Sc and Cr. The thickness of the first layer is adapted to the transmissive for the X-rays generated in the second layer. For a Sc first layer the thickness is about 5 μm.

The first layer in a preferred embodiment consists of Cr or Sc with a thickness of, for example, between 1 μm and 10 μm, the second layer consisting of Mo, Rh, Pd, Ag, Nb or U. For a first layer of Sc, Mo or Cr it is attractive from a metallurgical point of view to select W or U for the second layer. On the surface of the layer directed to the impinging electrons described up to now a layer consisting of Be can be mounted for long wave length radiation if desired.

For a reflection X-ray tube, the various layers may be provided on an anode target plate of, for example, copper or silver in the manner disclosed in U.S. Patent Application Ser. No. 609,615 filed on 14 May 1984.

For a transmission X-ray tube, use can be made, for example, of a first layer of Sc or Cr on which there is provided a second layer selected from Mo, Rh, Pd, Ag, Ta, W, Re, Au and U, said layers being provided on a beryllium exit window. Particularly attractive is Sc for the first layer and Mo for the second layer, respectively Cr for the first layer and Mo, Rh, Pd or Ag for the second layer.

BRIEF DESCRIPTION OF THE DRAWING

Some preferred embodiments of the invention will be described in detail hereinafter by way of example, with reference to the drawing which show in FIG. 1 an X-ray tube according to the invention and in FIGS. 2 and 3 parts thereof.

DESCRIPTION OF THE PREFERRED EMBODIMENTS

Figure 1:
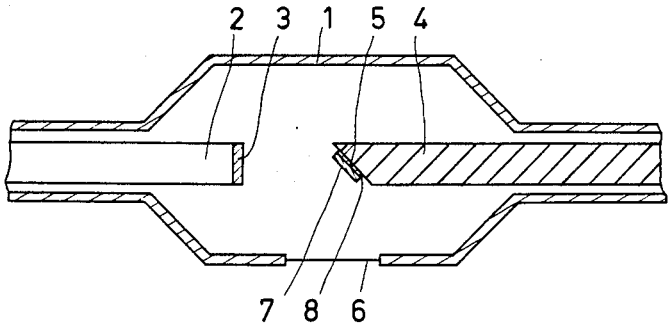

An X-ray tube as diagrammatically shown in FIG. 1 comprises an evacuated envelope 1 in which a cathode 2 with an electron-emissive element 3 and an anode block 4 with an anode target plate 5 are accommodated. Different potential differences can be applied between the anode and the cathode. An X-ray beam which emerges via an exit window 6 can irradiate (if desired via a radiation filter) a monochromator crystal or a specimen arranged in an X-ray analysis apparatus. The anode target plate 5 comprises a first layer 7 of Sc or Cr and a second layer of anode material which is chosen from the group of metallurgically appropriate elements having a sufficiently high atomic number such as Mo, Rh, Pd, Ag, W and U. Considering its function in the X-ray tube, the thickness of this layer is not critical, as long as any X-rays generated in the anode block 4 itself, which consists, for example, of copper, are prevented from reaching the exit window via this layer. Even an X-ray beam generated with a comparatively large potential difference between the cathode and the anode then remains free from this radiation which could have a disturbing effect because of its unwanted wavelength.

Figure 2:
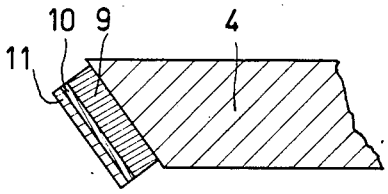

On the second layer of anode material the first layer of anode material which consists, for example, of scandium or chromium is provided. This layer is preferably comparatively thin, because any radiation generated in the second layer must be capable of passing through this first layer. A layer thickness of from approximately 1

μm to some tens of μm, depending on the desired radiation spectrum and the potentials to be applied, is suitable in this respect. FIG. 2 shows in an enlarged scale, the anode section of such a tube. On the anode block 4 there is fixed an anode target disc 9 on which there is provided, for example by adhesion, sputtering, casting or chemical electrolysis, a second layer 10 of anode material and, for example by adhesion or sputtering, a first layer 11 of anode material.

A favorable combination of materials for the first and second layers of such a reflection anode is, for example, scandium for the first layer, and molybdenum, rhodium or tungsten, or if desired a combination thereof, for the second layer. The anode target disc 9 preferably consists of silver or copper. When chromium is used for the first layer of anode material, palladium, silver or molybdenum or a combination thereof can be suitably used as the material for the second layer of anode material. As an alternative to the described embodiments, it may be advantageous to manufacture the anode target disc from one of the materials used for the second layer of anode material. This is particularly true when silver is used as the second anode material, because the heat conductivity thereof is adequate and suitable adhesion to the anode block 4 is readily achievable.

Figure 3:
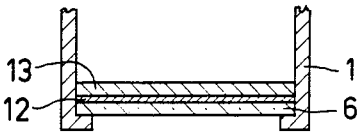

FIG. 3 diagrammatically shows one form of a relevant anode section for a transmission X-ray tube embodying the invention. On an exit window 6 which is mounted in the tube wall 1, and which is preferably made of beryllium, there is provided a first layer 12 of anode material which in this case consists of an element having a comparatively low atomic number, preferably scandium or chromium. This layer performs the function of the first layer of anode material but, contrary to the previously described reflection anode, it is arranged behind the second layer 13 of anode material, viewed in the direction of the incident electron beam. The thickness of this latter layer, which is composed of one or more elements having a comparatively high atomic number, is sufficiently small to allow the incident electrons, or the X-rays generated thereby in the second layer of anode material, to produce a sufficient amount of X-rays in the first layer. The second layer 13 of anode material has a thickness of, for example, approximately 1 μm and, when chromium is used for the first layer, this second layer consists of, for example, molybdenum, palladium or silver, whilst when scandium is used for the first layer, it consists of, for example, molybdenum, rhodium or tungsten.

An X-ray tube embodying the invention is particularly suitable for use in an X-ray analysis apparatus which is constructed to demonstrate the presence in a specimen of elements having a low atomic number, for which purpose the first layer of anode material consisting of one or more light elements is provided, as well as the presence of elements having a higher atomic number, for which purpose the second layer of anode material consisting of one or more heavier elements is used with a higher voltage on the X-ray tube. For the light elements a radiation spectrum which contains a sufficient amount of long-wave radiation can be generated in the tube, so that detection of elements having a low atomic number is possible. Consequently, it is unnecessary to change the X-ray tube during the execution of a complete analysis; if desired, one may switch over to a difference voltage on the X-ray tube.

What is claimed is:

1. An X-ray tube comprising an anode target for emitting X-rays when struck by electrons, a cathode disposed opposite the anode target for emitting target striking electrons when an accelerating potential difference is applied between the cathode and the anode target, and an evacuated envelope containing the cathode and the anode target and having an X-ray permeable window for passing the X-rays emitted by the target;

characterized in that said anode target comprises, in order from the window:

(a) a first layer consisting essentially of a material having a maximum atomic number of approximately 30, for emitting long wavelength X-rays when a first predetermined accelerating potential difference is applied; and (b) a second layer consisting essentially of a material having a minimum atomic number of approximately 40, for emitting short wavelength X-rays when a second predetermined accelerating potential difference is applied;

said first layer having a thickness which is sufficiently small to facilitate passage therethrough of X-rays emitted by the second layer.

2. An X-ray tube as in claim 1 where the target anode comprises a reflection anode, said first layer facing the electron emitting cathode and the window, and said second layer having a thickness which is sufficiently large to prevent emitted electrons from passing therethrough.

3. An X-ray tube as in claim 1 where the target anode comprises a transmission anode, said first layer facing the window, and said second layer facing the cathode.

4. An X-ray tube as in claim 1, 2 or 3 where the first layer consists essentially of at least one material selected from the group consisting of scandium and chromium, and where the second layer consists essentially of at least one material selected from the group consisting of niobium, molybdenum, tungsten, thorium and uranium.

5. An X-ray tube as in claim 1, 2 or 3 where the first layer consists essentially of scandium, and where the second layer consists essentially of at least one material selected from the group consisting of molybdenum, tungsten and uranium.

6. An X-ray tube as in claim 1, 2 or 3 where the first layer consists essentially of chromium, and where the second layer consists essentially of at least one material selected from the group consisting of molybdenum, tungsten and uranium.

7. An X-ray tube as in claim 1, 2 or 3 where a layer consisting essentially of beryllium is disposed on the one of said first and second layers which is struck by the electrons from the cathode.

8. An X-ray tube as in claim 1 or 2 where said second layer is disposed on an anode target block consisting essentially of a material selected from the group consisting of silver and copper.

9. An X-ray tube as in claim 1 or 2 where the second layer is formed by a portion of an anode target plate which supports said first layer.

10. An X-ray tube as in claim 3 where the X-ray permeable window consists essentially of beryllium, and where the first layer is disposed on said window.

11. An X-ray tube as in claim 1 or 2 where the first layer has a thickness lying in the range from approximately 1 micrometer to 10 micrometers.

12. An X-ray tube as in claim 11 where the first layer consists essentially of at least one material selected from the group consisting of chromium and scandium, and where the second layer consists essentially of at least one material selected from the group consisting of molybdenum, rhodium, palladium, silver, niobium and uranium.

13. An X-ray tube as in claim 2 where the first layer has a thickness of approximately 5 micrometers and consists essentially of scandium, and where the second layer consists essentially of a material selected from the group consisting of zirconium, niobium, molybdenum, rhodium, palladium, silver, tantalum, tungsten, rhenium, gold and uranium.

* * * * *